US008574376B2

(12) United States Patent
Classen et al.

(10) Patent No.: US 8,574,376 B2
(45) Date of Patent: Nov. 5, 2013

(54) WATER-CONDUCTING HOUSEHOLD APPLIANCE AND METHOD FOR THE OPERATION THEREOF

(75) Inventors: Egbert Classen, Stahnsdorf (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 183 days.

(21) Appl. No.: 13/010,803

(22) Filed: Jan. 21, 2011

(65) Prior Publication Data

US 2011/0114122 A1 May 19, 2011

Related U.S. Application Data

(62) Division of application No. 11/793,705, filed as application No. PCT/EP2005/055406 on Oct. 20, 2005, now Pat. No. 7,909,941.

(30) Foreign Application Priority Data

Dec. 23, 2004 (DE) ..... 10 2004 062 242

(51) Int. Cl.
*B08B 3/00* (2006.01)

(52) U.S. Cl.
USPC ..... 134/56 D; 134/57 D; 134/104.1; 134/111; 15/3

(58) Field of Classification Search
None
See application file for complete search history.

(56) References Cited

U.S. PATENT DOCUMENTS

| | | | |
|---|---|---|---|
| 3,179,116 | A | 4/1965 | Jacobs |
| 4,915,835 | A | 4/1990 | Barzuza et al. |
| 2003/0159720 | A1 | 8/2003 | Favret |
| 2009/0162627 | A1 | 6/2009 | Hirai et al. |
| 2010/0328467 | A1 | 12/2010 | Yoshizumi |

FOREIGN PATENT DOCUMENTS

| | | | |
|---|---|---|---|
| CH | 641371 | | 2/1984 |
| CH | 641969 | | 3/1984 |
| DE | 2922552 | A1 | 12/1980 |
| DE | 2945929 | A1 | 5/1981 |
| DE | 3633441 | A1 | 4/1988 |
| DE | 4236931 | A1 | 5/1993 |
| DE | 9415486 | U1 | 9/1994 |
| EP | 0990413 | A1 | 4/2000 |
| EP | 1256308 | B1 | 11/2002 |
| GB | 1375628 | | 11/1974 |
| JP | 2002246357 | A | 8/2002 |
| SU | 417145 | | 2/1974 |

OTHER PUBLICATIONS

Report of Examination JP 2007-547406 mail date Aug. 11, 2010.

*Primary Examiner* — Eric Golightly
(74) *Attorney, Agent, or Firm* — James E. Howard; Andre Pallapies

(57) ABSTRACT

A dishwasher includes a plurality of water circuits in which rinsing liquid is circulated according to a program control unit. The circulation of the rinsing liquid results in the passage of the rinsing liquid through at least one filter element that captures dirt entrained with the rinsing liquid. The filter element may include a plurality of thread elements disposable between a dirt capture state in which the thread elements are under tension, whereupon the thread elements intercept dirt entrained with the rinsing liquid while the rinsing liquid passes through the thread elements, and a relaxed state, in which the thread elements are disposed under less tension than in the dirt capture state to facilitate release of intercepted dirt from the thread elements, whereby the at least one filter element can be cleared of intercepted dirt.

3 Claims, 3 Drawing Sheets

WATER-CONDUCTING HOUSEHOLD APPLIANCE AND METHOD FOR THE OPERATION THEREOF

CROSS-REFERENCE OF RELATED APPLICATIONS

This application is a Divisional, under 35 U.S.C. §121, of U.S. application Ser. No. 11/793,705, filed Jun. 20, 2007 and issued as U.S. Pat. No. 7,909,941 on Mar. 22, 2011, which is a U.S. national stage application of PCT/EP2005/055406 filed Oct. 20, 2005, which designated the United States; this application also claims the priority, under 35 U.S.C. §119, of German patent application No. 10 2004 062 242.6 filed Sep. 23, 2004.

BACKGROUND OF THE INVENTION

The invention relates to a water-conducting household appliance, especially a dishwasher having at least one essentially closed water circuit in which rinsing liquid can be circulated according to a program control unit, the rinsing liquid being conveyed through a filter element while circulating in order to filter out dirt. The invention further relates to a method for operating a water-conducting household appliance.

During the operation of a dishwasher and depending on the degree of soiling of the items being washed, large or small particles of dirt are dislodged from the items for rinsing by the rinsing liquid. In order, to prevent dirt already dislodged from the items for rinsing being transferred back onto said items by means of the rinsing liquid circulating during a particular section of the wash program, filter arrangements are arranged in the area of the washing tub or the pump well of known dishwashers. Here, a filter arrangement arranged in the pump well frequently consists of a coarse filter, which filters out from the rinsing liquid large-diameter particles of dirt, a fine filter, the mesh diameter of which lies in the range of 0.9 to 1.1 mm, and a microfilter arranged downstream of the fine filter, the mesh diameter of which is approximately 0.3 mm in order to filter out from the rinsing liquid small particles of dirt. The purpose of a filter arrangement of this kind is to filter out from the rinsing liquid as great as possible a proportion of dirt particles during circulation of said rinsing liquid. When the rinsing liquid is pumped out, for example when switching from one section of the wash program to the next, as much as possible of the dirt should be conveyed out of the washing space of the dishwasher, in order to prevent the filter arrangement from becoming clogged.

One disadvantage of the arrangement just described lies in the fact that in practice, only a portion of the dirt retained in the filter arrangement can be removed when the dishwasher is pumped out. Accordingly it is necessary that at least some of the filter elements of the filter arrangement are occasionally removed from the dishwasher by a user and manually cleaned. In order to spare said user of the dishwasher an unpleasant chore of this nature, it would be desirable if the filter arrangement were of the self-cleaning type.

A dishwasher with such a self-cleaning filter is known for example from U.S. Pat. No. 3,179,116. The filter herewith consists of a helical spring, the gaps of the spiral sections lying one above the other being variably adjustable. Upon circulation of the rinsing liquid from the washing tub to the spray arms, the spring is of lesser length and the gaps of the spiral sections thus small, so that the dirt dislodged by the rinsing liquid is filtered by the spiral spring. Upon pumping-out of the rinsing liquid, which is effected by reversing the direction of rotation of the pump, the length of the spiral spring is increased, as a result of which the distance between two adjacent spring sections increases so that dirt adhering to the spiral spring is flushed into the interior of the spiral spring, and subsequently conveyed to the water outlet. The alteration in the length of the spiral spring is effected by water pressure generated in the lines, which is dependent upon the direction of operation of a circulation pump. During the circulation, a low water pressure only is generated in a line connected to the spiral spring, by means of which the spiral spring remains of reduced length. Upon pumping out, on the other hand, high pressure is generated in the line connected to the spiral spring, by means of which the spiral spring is lengthened via a lever mechanism.

One disadvantage of the arrangement described is that the self-cleaning of the filter can only take place upon switching from one section of the wash program to the next. If, however, during one section of the wash program, the filter is subject to a large quantity of dirt, it is no longer possible for the pump to circulate sufficient rinsing liquid to soak the items being washed. The proposed arrangement thus takes into account that the cleaning effect of individual sections of the wash program may be reduced.

From DE 36 33 441 A1 an apparatus for the washing of clothing is known which has a fluff filter embodied as a disk filter and a fine filter. The fluff filter consists of wires running in parallel with each other, and is arranged in such a way that a liquid inlet aperture is located above the upper end of the wire layer and one of two liquid outlet apertures immediately behind the lower end of the wire layer. The other outlet aperture of the disk filter leads to the inlet side of the supply pump, and is located in any position in the base area of the fluff filter housing. The disk filter makes it possible during the ongoing throughput of the washing water in a number of program sections, to be able to slide fluff along the parallel wires as far as the lower end of the wire layer in front of the closable liquid outlet aperture. Upon the end of the program sections, the dirt (fluff) is then washed into the drainage system together with the outflowing washing water, by opening of the liquid outlet aperture. The fine filter serves solely to hold back detergent rinsed out of the items of clothing.

As the particles of dirt encountered during the operation of a dishwasher vary much more widely in terms of their size and properties than is the case when washing clothes, the filter described in DE 36 33 441 A1 cannot be employed in a dishwasher. In addition, as in the case of U.S. Pat. No. 3,179,116, there is the disadvantage that cleaning of the filter is only possible upon the transition from one washing program to the next.

Finally, filters for major industrial use are known from DE-OS 2 249 603 and DE-OS 29 22 549, which on account of their variable filter gaps or diameters demonstrate self-cleaning properties.

BRIEF SUMMARY OF THE INVENTION

The object of the present invention thus consists in specifying a water-conducting household appliance, especially a dishwasher, which renders superfluous the manual cleaning of filter elements used to retain dirt, wherein the qualitative properties of the household appliance in terms of energy consumption and cleaning performance are to be optimized. Further, a method for the operation of such a water-conducting household appliance is to be specified.

According to the invention, a further water circuit is provided in the water-conducting household appliance, through which the rinsing liquid is circulated according to the program control unit when the filter element is covered with dirt, in order to effect the cleaning of said filter element. The provision of a further water circuit makes it possible, in an advantageous manner, for self-cleaning of the filter element also to be performed during a section of the washing program, without this necessitating the pumping-out of the rinsing liquid currently being used in the household appliance. The provision of the additional water circuit further reliably prevents dirt dislodged from the filter element finding its way into the closed water circuit, thus avoiding this dislodged dirt adhering to the items to be washed.

In an expedient embodiment, the filter element is integrated onto or into a pump well of the dishwasher in such a way that it is properly rinsed by the rinsing liquid flowing or conveyed in the further water circuit. This guarantees that all or at least a large part of the dirt adhering to the filter element can be loosened by the rinsing liquid circulated in the further water circuit.

In a further embodiment, the filter element has a variable mesh or column width for the provision of a first and a second operating state, where the filter element carries out the filtering of dirt from that located in the water circuit in the first operating state, and in the second operating state enables loosening of the dirt trapped in the filter element upon circumflow of the rinsing liquid being conveyed by the further water circuit. The use of a filter element of this kind facilitates the removal of dirt because through the alteration of the mesh or column width, in particular an increase, residues can be simply removed as rinsing liquid flows through the filter element. By setting a narrow mesh or column width, on the other hand, a spatially even layer of the filter element is formed, having a large capacity and enabling a high degree of cleaning on the part of the rinsing liquid when circulated in the closed water circuit.

In a further embodiment the arrangement of a further filter element in the further water circuit is provided for. By means of this, the dirt dislodged from the filter element is trapped by the further filter element of the further water circuit, by means of which with the increasing duration of the circulation in the further water circuit, the rinsing liquid flowing through the filter element is freed of ever increasing residues. In other words, this means that the dirt is removed from the closed water circuit, the pump well and the filter element, the result of which being that the items being washed are always impinged upon by rinsing liquid which is filtered to the optimum possible degree. Additionally, the rinsing performance is not impaired by an increasingly clogged filter element, since a filter element with constant filtration performance is created through the action of the further water circuit.

The further filter element is expediently arranged in a collection receptacle. This enables collection of the dirt conveyed in the further water circuit.

In a further embodiment, the further filter element has a variable mesh or column width for the provision of a first and a second operating state, where the filter element carries out the filtering of dirt from that located in the water circuit in the first operating state, and in the second operating state enables loosening of the dirt trapped in the filter element upon the circumflow of the rinsing liquid being conveyed by the further water circuit. In other words the further filter element is thus embodied in self-cleaning form. This ensures constant filter performance of the second filter element during operation of the further water circuit.

According to another embodiment, the further water circuit is integrated into a water outlet, so that the rinsing liquid supplied in the further water circuit can optionally be conducted to the dishwasher or the waste water outlet according to the program control unit. It is advantageous here that the further water circuit be operated in such a way that the further filter element is in the first operating state when the rinsing liquid is being circulated in the household appliance. Accordingly, the further filter element is in the second operating state, in which it enables cleaning, with the dirt being directed to the water outlet. After "intermediate storage" of the dirt in the further filter element or the collection receptacle, the dirt is conveyed out of the household appliance.

In a dishwasher according to the invention with at least one essentially closed water circuit in which rinsing liquid can be circulated according to the program control unit, it being possible during circulation to convey said rinsing liquid through at least one filter element for the purposes of filtering out dirt, the at least one filter element consisting of thread elements which are arranged under tension for cleaning of the rinsing liquid and in a relaxed state for cleaning the filter element.

In a further embodiment, the thread elements are arranged on retaining elements and in the tensioned state are essentially arranged on one level or in bent form, for example in cylindrical form.

The inventive method for operation of a water-conducting household appliance, especially a dishwasher, with a washing program comprising a number of program sections, comprises the following steps: During the course of the washing program the filter element is operated in a first operating state, in which it undertakes filtration of the rinsing liquid for removal of dirt from the closed water circuit. According to the program control unit or upon detection of a defined degree of soiling of the filter element with dirt, the further water circuit is activated and the filter element brought into a second operating state for the dislodging of the dirt present upon it.

The inventive method is associated with the same advantages as previously explained in connection with the water-conducting household appliance.

In one embodiment of the invention, the second filter element is operated in its first operating state with an activated further water circuit in order to rid the rinsing liquid being conveyed in the further water circuit of dirt.

In another embodiment, after completion of the washing program or according to the program control unit, the further filter element is brought into a second operating state, in which dirt located on or in said further filter element is flushed out of the further filter element by the rinsing liquid being conveyed in the further water circuit.

According to a further embodiment the rinsing liquid being conveyed in the further water circuit is directed to the water outlet while the further filter element is in the second operating state.

The inventive water-conducting household appliance thus advantageously makes it possible to perform self-cleaning of the filter element of the closed water circuit even during a washing program section instead of awaiting in all circumstances the end of the washing program as proposed in the prior art. Washing performance can thereby be kept at a constantly high level during a section of the washing program, without additional fresh water having to be introduced into the water-conducting household appliance.

BRIEF DESCRIPTION OF THE DRAWINGS

The invention and its advantages are described by way of example below in further detail with reference to the drawings, in which.

DETAILED DESCRIPTION OF EXEMPLARY EMBODIMENTS OF THE PRESENT INVENTION

Figure 1:
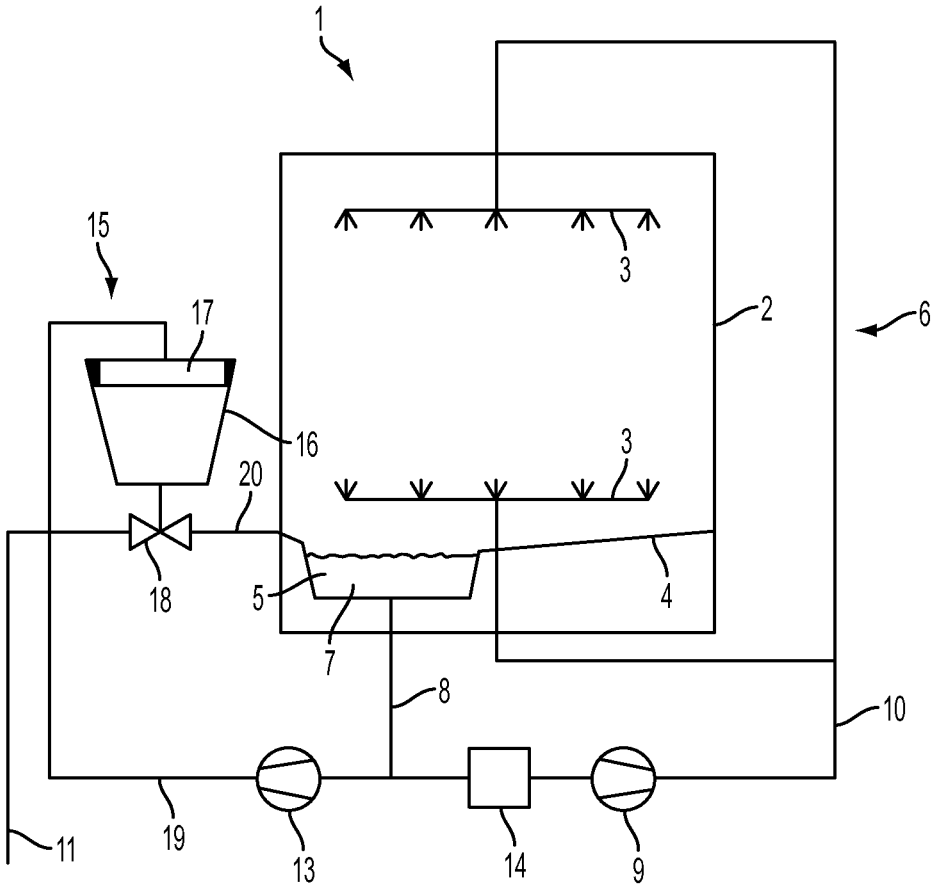
FIG. 1 shows a diagrammatic representation of a water-conducting appliance embodied as a dishwasher with a further water circuit.

In FIG. 1 a dishwasher 1 is represented in a diagrammatic view. The dishwasher 1 essentially comprises a washing space 2, in which are arranged items to be rinsed, which are not represented, a rinsing liquid circuit 6, a water inlet (not represented in detail in the figure) and a water outlet 11. The item to be rinsed is arranged in the washing space 2 between the washing or spay arms 3. A washing tub 5 is arranged below the item to be rinsed and the spray arms 3, said washing tub 5 directing the rinsing liquid present in the washing space into a pump well 5. Said pump well 5 belongs to the rinsing liquid circuit 6, in which is circulated the rinsing liquid 7 required for a washing procedure. During the washing procedure, which can comprise the program sections prewash, cleaning, intermediate rinsing and rinsing, rinsing liquid is removed from the pump well 5 via a line 8, and conducted to a pump 9 via a filter element 14. From the pump 9, the rinsing liquid, after passing thorough an instantaneous water heater (not shown), is conducted via lines 10 to the spray arms 3, and sprayed from these into the washing space 2. In the washing space 2, the rinsing liquid 7 then runs via the washing tub 4 into the pump well 5 once again. The pump well 5 is connected to the water outlet 11, via which the rinsing liquid can be drawn off. After each washing cycle, for example, part or all of the rinsing liquid is drained off via the water outlet 11. Filling of the pump well takes place with the aid of the water inlet, which provides a supply of fresh water. In addition the dishwasher 1 can have further elements which are not shown in the figure, for example a mechanism for the dosing of detergent, a descaling system, sensors and the like.

Through the impinging of rinsing liquid onto the items to be rinsed, dirt is dislodged from the latter and initially collected in the pump well 5, in order then through operation of the pump 9 to be filtered out of the circulated rinsing liquid in the filter element 14. Depending on the degree of soiling of the items to be rinsed or the number of washing program sections already performed, the filter element 14 will be to a greater or lesser degree impinged upon with dirt. Under certain circumstances this may result in the pump 9 no longer being able to convey sufficient rinsing liquid out of the pump well 5, with the result that the items to be rinsed are impinged upon with less rinsing liquid, so that the washing results are poorer.

Figure 2A:
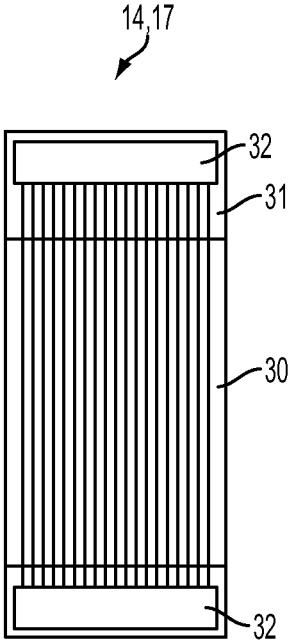
FIG. 2*a*, 2*b* shows a diagrammatic representation, in the form of a side-view and a cross-sectional view, of a filter element which can be used in the household appliance represented as an exemplary embodiment in FIG. 1, said filter element being represented in a first operating state.
Figure 2B:
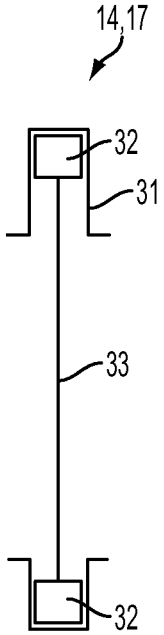
Figure 3A:
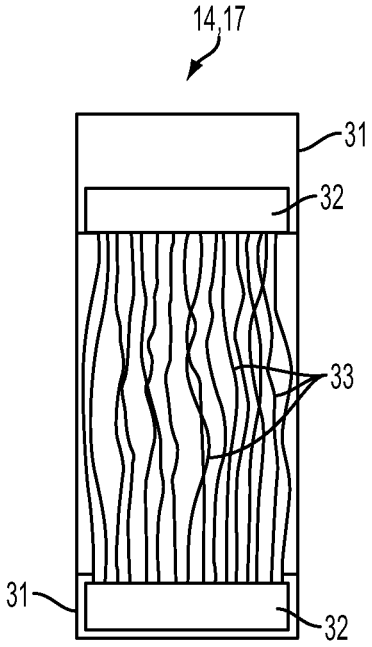
FIG. 3*a*, 3*b* shows a diagrammatic representation, in the form of a side-view and a cross-sectional view, of a filter element which can be employed in the household appliance represented as an exemplary embodiment in FIG. 1, said filter element being represented in a second operating state
Figure 3B:
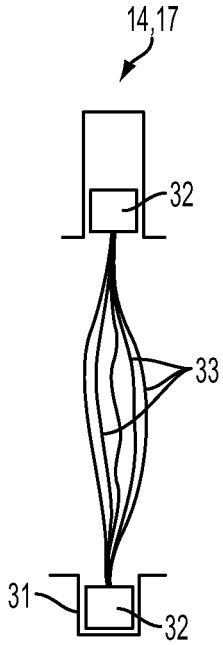

In order to avoid manual cleaning of the filter element 14, this is embodied as a self-cleaning filter element. Such a self-cleaning filter element is represented as an exemplary embodiment in FIGS. 2 and 3, a first operating state being shown in FIG. 2 in which filtering of the rinsing liquid passing through it is effected. FIG. 3 shows the filter element in a second operating state, in which self-cleaning is possible. Flow through the filter elements represented in the figures is here perpendicular to the blade plane.

For this purpose the filter element has a securing elements 32 arranged in a housing 30 embodied with guides 31, between which are arranged thread elements 33, for example made of metal, plastic or other material. By means of tensioning of the thread elements 33 the parallel alignment with defined gaps relative to each other as shown in FIG. 2*a* is achieved. Depending on the desired filter effect, the gap can be defined by fixing the thread elements 33 in the securing elements 32. The tensioning and relaxation of the thread elements 33 with the securing elements 32 is effected by means of appropriate mechanisms, e.g. spindles or hydraulic mechanism. In the side view of FIG. 2*b* it can be seen that all thread elements 33 lie in a single plane, thereby achieving a good filtration effect. If at least one of the two securing elements 32 moves in the direction of the other securing element, the thread elements 33 are able to relax, as shown in the figure, such that the gaps are widened in a more or less random manner. When rinsing liquid then flows through the filter element in the second operating state, the dirt held on or in it can then be flushed out.

The self-cleaning procedure of the filter 14 can either be controlled by a program control unit (not shown in the figures) or carried out upon detection of a defined degree of soiling of the filter element 14. With the increasing soiling of the filter element 14, the amount of rinsing liquid conveyed through the pump 9 diminishes. Conclusions as to the level of soiling of the filter element can then be reached on the basis of the amount of rinsing liquid conveyed, as measured after the filter element 14.

For cleaning of the filter element 14, the filter element 14 is brought to its second operating state, as described in connection with FIG. 3. At the same time a further pump 13 is brought into operation, which conveys the rinsing liquid 7 in the pump well 5 through a further water circuit 15. The pump 13 is located in the further water circuit 15, which additionally has a collection receptacle 16, in which is arranged a further filter element 17. On the output side the collection receptacle 16 may be connected, via a valve 18, optionally to the water outlet 11 or a line 20 which conveys rinsing liquid circulated in the further water circuit 15 back into the pump well 5.

In order to be able to effect self-cleaning of the filter element 14, the rinsing liquid conveyed through the further water circuit 15 must circumflow this. In practice, the filter element 14 is thus arranged at a suitable location in the line 8, or directly on or in the pump well 5.

Via the pump 13 and the line 19 the dirt dislodged from the filter element 14 is trapped by the filter element 17, which is preferably likewise embodied in self-cleaning form. The rinsing liquid conveyed through the further water circuit 15 is thus cleaned at the outlet of the collection receptacle 16 and, insofar as the water circuit was actuated during a section of the washing program, is conducted to the pump well 5. After a particular period of time, the further water circuit 15 can be deactivated, with the filter element 14 simultaneously being brought into its first operating state. The interrupted washing program can subsequently be resumed. It is, of course, also possible to perform the self-cleaning of the filter element 14 at the end of a washing program section. In this case, for example, the rinsing liquid cleaned by the further filter element 17 could be utilized for the next washing program section, thus making it possible to forego the introduction of fresh water.

As the dirt now dislodged from the items being rinsed is trapped in the further filter element 17, and the cleaning effectiveness of the further filter element 17 deteriorates with the increasing duration of operation of the further water circuit 15, self-cleaning of the further filter element 17 will always take place when the rinsing liquid of a washing program is to be conducted to the water outlet 11. With the corresponding actuation of the valve 18, the further filter element is switched to its second operating state, so that the rinsing liquid conveyed from the pump well 5 via the pump 13 can dislodge the dirt trapped in the further filter element 17, which is then conducted to the water outlet.

What is claimed is:

1. A dishwasher comprising:

an assembly for retaining therein a rinsing liquid;

a program control unit;

a plurality of water circuits in which rinsing liquid can be circulated in accordance with a program controlled by the program control unit; and at least one filter element, wherein the circulation of the rinsing liquid results in a passage of the rinsing liquid through the at least one filter element that captures dirt entrained with the rinsing liquid, the at least one filter element including a plurality of thread elements disposable between a dirt capture state in which the thread elements are under tension, whereupon the thread elements intercept dirt entrained with the rinsing liquid while the rinsing liquid passes through the thread elements, and a relaxed state in which the thread elements are disposed under less tension than in the dirt capture state to thereby facilitate release of intercepted dirt from the thread elements, whereby the at least one filter element can be cleared of intercepted dirt.

2. The dishwasher as claimed in claim 1, wherein the thread elements are arranged on securing elements, and when under tension are arranged in one level or in bent form.

3. The dishwasher as claimed in claim 1, wherein the plurality of water circuits includes a first water circuit in which rinsing liquid can be circulated in accordance with a program controlled by the program control unit, the rinsing liquid being capable of being conveyed through a first filter element while circulating such that the first filter element captures dirt entrained with the rinsing liquid and a second water circuit through which the rinsing liquid can be circulated in accordance with a program controlled by the program control unit when the first filter element has captured a predetermined quantity of dirt, whereby dirt captured by the first filter element can be cleared from the first filter element.

* * * * *